US005815128A

United States Patent [19]

Hoshino et al.

[11] Patent Number: 5,815,128

[45] Date of Patent: Sep. 29, 1998

[54] GRAY SHADE DRIVING DEVICE OF LIQUID CRYSTAL DISPLAY

[75] Inventors: Masafumi Hoshino; Fujio Matsu; Shuhei Yamamoto, all of Chiba, Japan

[73] Assignee: Seiko Instruments Inc., Japan

[21] Appl. No.: 579,250

[22] Filed: Dec. 27, 1995

[30] Foreign Application Priority Data

Dec. 27, 1994 [JP] Japan ..... 6-326108

[51] Int. Cl.[6] ..... G09G 3/36

[52] U.S. Cl. ..... 345/89; 345/87; 345/100; 345/147; 359/264

[58] Field of Search ..... 345/89, 94, 147, 345/95–96, 100, 103, 87; 359/264

[56] References Cited

U.S. PATENT DOCUMENTS

| | | | |
|---|---|---|---|
| 5,420,604 | 5/1995 | Scheffer et al. | 345/87 |
| 5,473,338 | 12/1995 | Prince et al. | 345/94 |
| 5,485,173 | 1/1996 | Scheffer et al. | 345/87 |
| 5,532,713 | 7/1996 | Okada et al. | 345/97 |
| 5,621,425 | 4/1997 | Hoshino et al. | 345/94 |

FOREIGN PATENT DOCUMENTS

| | | |
|---|---|---|
| 507061 | 10/1992 | European Pat. Off. . |
| 598913 | 6/1994 | European Pat. Off. . |
| 604226 | 6/1994 | European Pat. Off. . |

*Primary Examiner*—Richard A Hjerpe
*Assistant Examiner*—Ricardo Osorio
*Attorney, Agent, or Firm*—Adams & Wilks

[57] ABSTRACT

A liquid crystal display panel gray shade driving device comprises first circuitry for applying row signals represented by a set of orthonormal functions to a group of row electrodes throughout one frame by set sequential scanning for each of selecting periods, and second circuitry for sequentially carrying out a dot product computation between the set of orthonormal functions and a set of pixel data consisting of bits, and applying a column signal having a voltage level corresponding to a result of the computation to each of a group of column electrodes in synchronization with the set sequential scanning for each of the selecting periods. The first circuitry has a vertical driver for applying the row signal, by doubling the rate thereof, to the group of row electrodes and repeating the same set sequential scanning at least for two frames of previous and subsequent frames. The second circuitry has a frame memory for holding the pixel data in each frame while dividing it according to a significance of each bit and a dot product computing circuit for reading out the set of held pixel data per significance of each bit and carrying out the dot product computation to generate a column signal component corresponding to the significance of each bit. A horizontal driver divides the column signal components into a significant bit component and a less significant bit component, and distributes one component to the previous frame and the other to the subsequent frame to generate a column signal which is applied to the group of column electrodes.

7 Claims, 11 Drawing Sheets

RANDOM PATTERN (F1 – G1)

ALL-ON PATTERN (F1 – G2)

| | 1 | 2 | 3 | 4 |
|---|---|---|---|---|
| F 1 | +1 | +1 | +1 | +1 |
| F 2 | +1 | +1 | −1 | −1 |
| F 3 | +1 | −1 | −1 | +1 |
| F 4 | +1 | −1 | +1 | −1 |
| | 4 | 0 | 0 | 0 |

| | 1 | 2 | 3 | 4 |
|---|---|---|---|---|
| F 1 | | | | |
| F 2 | +1 | +1 | −1 | −1 |
| F 3 | +1 | −1 | −1 | +1 |
| F 4 | +1 | −1 | +1 | −1 |
| | 3 | 1 | 1 | 1 |

FIG. 8

| GRADATION | FIRST BIT | SECOND BIT | THIRD BIT |
|---|---|---|---|
| 0 | 0 | 0 | 0 |
| 1 | 0 | 0 | 1 |
| 2 | 0 | 1 | 0 |
| 3 | 0 | 1 | 1 |
| 4 | 1 | 0 | 0 |
| 5 | 1 | 0 | 1 |
| 6 | 1 | 1 | 0 |
| 7 | 1 | 1 | 1 |

GRAY SHADE DRIVING DEVICE OF LIQUID CRYSTAL DISPLAY

BACKGROUND OF THE INVENTION

The present invention relates to a device for driving a plain matrix liquid crystal display panel using STN liquid crystal or the like. More specifically, the present invention relates to a driving device suitable for a multiple line selection method and more particularly to a driving circuit structure suitable for gray shade display (half-tone display) by means of pulse width modulation and a frame thinning modulation.

A plain matrix type liquid crystal display panel is composed of a liquid crystal layer interposed between a group of row electrodes and a group of column electrodes thereby providing pixels in a matrix. Conventionally, such liquid crystal display panel are driven by a voltage averaging method. In this method, the respective row electrodes are sequentially selected one by one, and data signals corresponding to ON/OFF status are supplied to the while column electrodes in synchronization with that timing. Consequently, each pixel receives a high applied voltage for one time slot (1/N of a time interval) within one frame period, during which all of (N number of) the row electrodes are selected, while the same pixel receives a constant bias voltage in the remaining time interval ((N−1)/N of the time interval). If the liquid crystal material used has a slow response, then there can be obtained a brightness corresponding to an effective value of the applied voltage waveform during one frame period. However, if a frame frequency in lowered as the multiplexing number increases, the difference between the one frame period and a liquid crystal response time is reduced, so that the liquid crystal responds to each applied pulse to thereby causing a brightness flicker called a "frame response" phenomenon which degrades the contrast.

As means to deal with such a problem of the frame response phenomenon in the voltage averaging method, a "high frequency method" by which a width of pulses of the applied voltage is reduced has been proposed. The frame frequency increases as the pulse width is reduced. Because a voltage pulse during selection is applied in a short period, the next voltage pulse is applied before a transmittance drops, thereby increasing the transmittance of the whole. However, this high frequency method is limited as an increase of strain of waveforms of the applied voltage remarkably damages the uniformity of an image, Recently, a "multiple line selection method" has been proposed as more effective means in dealing with the above-mentioned problem of the frame response phenomenon and is disclosed in Tokkai Hei. 5-100642, for example. In this multiple line section method, each of the row electrodes is not selected one by one in the conventional manner, but a plurality of row electrodes are simultaneously selected to achieve the same effect as the high frequency drive, thereby reducing the above-mentioned problem of the frame response. Being different from single line selection, the multiple line section requires a specific technique for realizing a free display. Namely, it is necessary to arithmetically process original pixel data and supply the processed data to a column electrode. Practically, a plurality of row signals represented by a set of orthonormal functions are Applied to the group of row electrodes in sequence of the set during each selecting period. On the other hand, a dot product computation is carried out sequentially between the set of orthonormal functions and a set of selected pixel data, and then a column signal that has a voltage level corresponding to a result of the computation is applied to the group of column electrodes in synchronization with the set sequential scanning during each selecting period.

The above-mentioned multiple line section can be also a extended for use with a gray shade display. There are a variety of methods for providing a gray shade display. For example, a pulse width modulation and a frame thinning modulation can be easily combined wit the multiple line section as disclosed in the above-mentioned Tokkai Hei. 5-100642. In this method, a given pixel data has a plurality of bits and gray shading is displayed therewith. When the dot product computation is carried out between the set of orthonormal functions and the set of pixel data, the set of pixel data is divided by the bits to carry out the computation and to generate a column signal component corresponding to a significance of each bit. Further, the column signal components corresponding to the significance of each bit are arranged in order during each selecting period to compose a column signal, which is applied to a group of column electrodes. At this time, a predetermined gray shade display may be obtained by applying the pulse width modulation or the frame thinning modulation per significance of each bit.

In the multiple line section method, basically row signals applied to the group of row electrodes may have any orthonormal waveform; however, all the concurrently selected row electrodes are necessarily scanned by a voltage pulse of the same polarity once within one frame. Meanwhile, the waveform of the column signal applied to each column electrodes is obtained by the dot product computation of the pixel data set and the orthonormal signal set as described before. Accordingly, as long as the pixel data represents a random gray shade picture pattern, the bias voltage is randomly distributed throughout the nonselection period within one frame. However, in case when the picture pattern is turned to either of a total white state (all ON) or total black state (all OFF), the bias voltage of the nonselection period is intensively applied at a time slot when all the concurrently selected row electrodes are scanned by the voltage pulse of the same polarity. For this, optical response is fluctuated, causing contrast variation dependent on the picture pattern. Thus, it is an object of the present invention to eliminate the fluctuation of the optical response dependent on the gray shade picture pattern.

SUMMARY OF THE INVENTION

The following measures have been taken in order to solve the above-mentioned problems of the prior art and to achieve the object of the present invention. That is, the gray shade driving device of the present invention basically drives a liquid crystal display panel in which a liquid crystal layer is held between a group of row electrodes and a group of column electrodes to provide pixels in a matrix, according to given pixel data composed of a plurality of bits.

The gray shade driving device has first means for applying a plurality of row signals represented by a set of orthonormal functions to the group of row electrodes throughout one frame by set sequential scanning for each of selecting periods. Further, the gray shade driving device has second means for carrying out dot product computation between the set of orthonormal functions and the set of selected pixel data, and applying a column signal that has a voltage level according to a result of the computation to the group of column electrodes in synchronization with the set sequential scanning for each of the selecting periods.

The present invention is characterized in that the first means has orthonormal function generating means for forming the plurality of row signals and vertical driving means for applying the row signals to the group of row electrodes by doubling the rate thereof and repeating the same set sequential scanning at least for two frames of foregoing and next frames. Meanwhile, the second means includes a frame memory for holding pixel data in each frame while dividing them by the bits and dot product computing means for executing the above-mentioned dot product computation by reading out the set of held pixel data per significance of each bit and generating row signal components corresponding to the significance of each bit.

The gray shade driving device also includes horizontal driving means which divides the row signal components into a significant bit column signal component and a less significant bit column signal component, distributes one component to the foregoing one frame and the other to the next one frame to compose a row signal which is applied to the group of column electrodes. Or, it is possible to arrange it so as to divide the significant bit column signal component and the less significant bit column signal component into half, respectively, and to distribute each half selected from the significant bit and less significant bit column signal components into the foregoing one frame and the remaining half into the next one frame to compose the column signal which is applied to the group of column electrodes. Preferably, the horizontal driving means applies the column signal components using both the pulse width modulation and the frame thinning modulation with respect to the less significant bit component while it applies the column signal components by the pulse width modulation with respect to the significant bit component.

BRIEF DESCRIPTION OF THE DRAWINGS

FIG. 8 is a table for explaining an operation of the gray shade display of the present invention;

DETAILED DESCRIPTION OF THE INVENTION

According to the present invention, the rate of the row signal is doubled and it is applied to the group of row electrodes and the same set sequential scanning is repeated at least for two frames of previous or foregoing and subsequent or next frames. Thereby, the rate of the frame frequency is apparently doubled, thus allowing the frame response phenomenon to be restrained. Accordingly, the fluctuation of the optical response may be improved even when the gray shading display patterns are all ON or all OFF. By the way, when the rate of the frame frequency is increased, the selection period is also shortened accordingly. When the gray shade display is carried out, the pulse width modulation is used and the column signal waveform is composed of a set of column signal components having different pulse widths throughout the significant bit to less significant bit components. Because the selection period is shortened along the doubling of the rate of the row signal, the pulse width of the column signal is also reduced. When the column signal is applied while reducing the pulse width thereof, the uniformity of an image is damaged by the increase of distortion of the pulse waveform.

Then, according to the present invention, the column signal is composed by dividing column signal components into significant bit and less significant bit components and by distributing one component to the foregoing one frame and the other to the next one frame. Thereby, it becomes possible to accommodate with the doubling of the rate of the row signal without reducing the pulse width of each column signal component. Or, the same effect can be obtained by dividing the significant bit column signal component and the less significant bit column signal component into half, respectively, and by distributing each half selected from the significant bit and less significant bit column signal components into the foregoing one frame and the remaining each half into the next one frame.

EMBODIMENT

Figure 1:
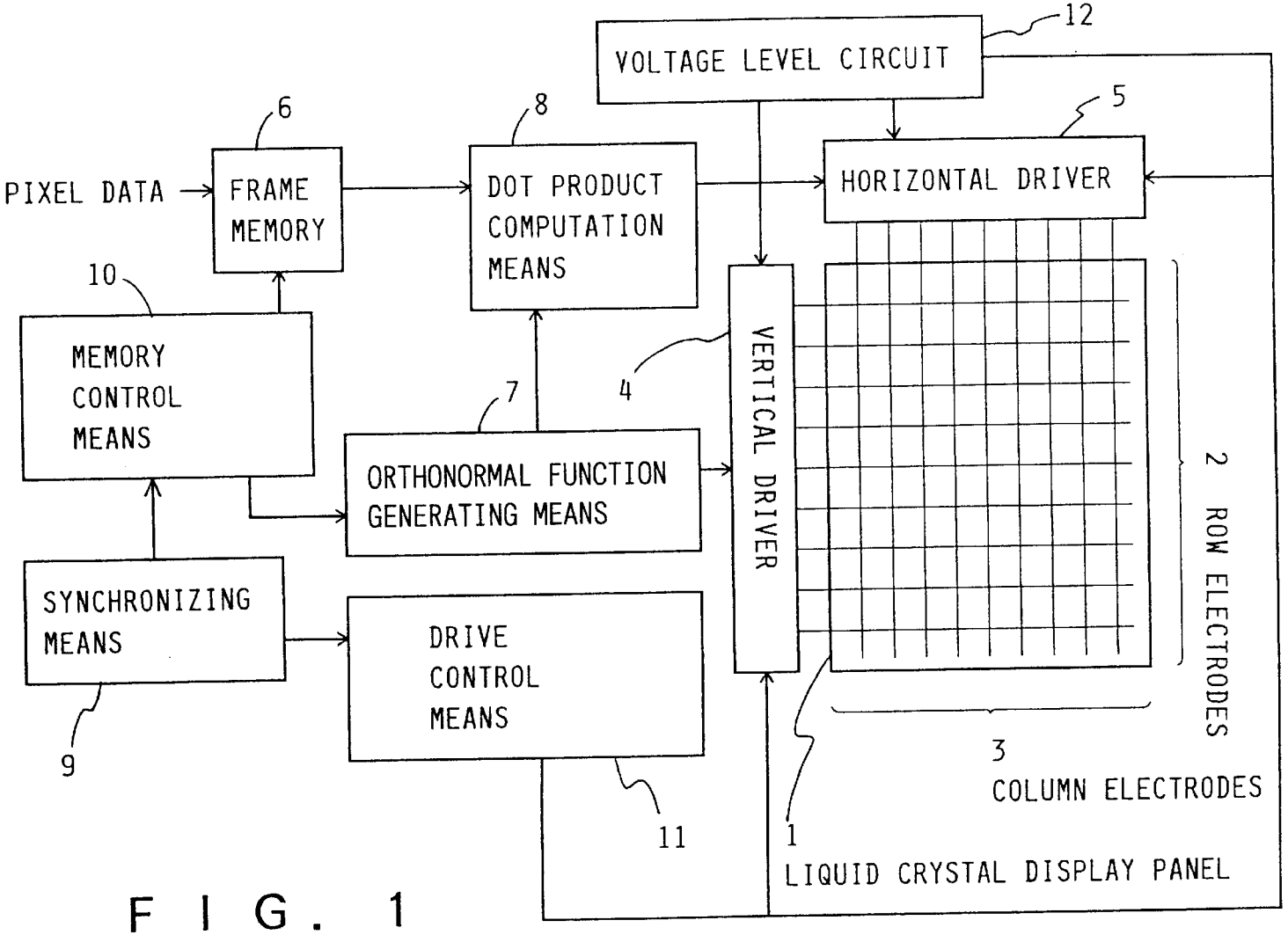
FIG. 1 is a schematic block diagram showing a liquid crystal display panel gray shade driving device of the present invention.

A preferred embodiment of the present invention will be explained below in detail with reference to the drawings. FIG. 1 is a schematic block diagram showing an inventive gray shade driving device of a liquid crystal display panel. As shown in the figure, the inventive gray shade driving device is connected with a plain matrix type liquid crystal display panel 1. The liquid crystal display panel 1 has a flat panel structure in which a liquid crystal layer is interposed between a group of row electrodes 2 and a group of column electrodes 3. STN liquid crystal, for example, can be used as the liquid crystal layer. The gray shade driving device drives in a gradation the liquid crystal display panel 1 having such a structure by using both pulse width modulation and frame thinning modulation methods according to pixel data composed of a plurality of bits.

The gray shade driving device is equipped with a vertical driver 4 which is connected with the group of row electrodes 2 to drive them. The gray shade driving device is also equipped with a horizontal driver 5 which is connected with the group of column electrodes 3 to drive them. The gray shade driving device further has a frame memory 6, orthonormal function generating means 7 and dot product computation means 8. The frame memory 6 holds pixel data input in each frame. It is noted that the pixel data represents the density of pixels provided at cross sections of the group of row electrodes 2 and the group of column electrodes 3. The pixel data is composed of a plurality of bits which enables pixel density to be displayed with gray shading in the present invention. In relation to this, the frame memory 6 has a bit plane corresponding to the significance of each bit.

The orthonormal function generating means 7 generates a plurality of orthonormal functions which are orthonormal to each other, and supplies sequentially the orthonormal functions in appropriate set patterns to the vertical driver 4. The vertical driver 4 applies a plurality of row signals represented by the sets of orthonormal functions to the group of row electrodes 2 by a set sequential scanning for each selecting period. At this time, the vertical driver 4 applies the row signals to the group of row electrodes 2 by doubling the rate the signal and repeats the same set sequential scanning at least for two frames of foregoing and next frames. As it may be apparent from the above description, the orthonormal function generating means 7 and the vertical driver 4 correspond to the above-mentioned first means.

The gray shade driving device further comprises the dot product computation means a and a voltage level circuit 12, in addition to the frame memory 6 and the horizontal driver 5, as second means. The second means sequentially carries out a dot product computation of a set of the orthonormal functions and a set of the pixel data and applies a column signal having a voltage level corresponding to that computation result to the group of column electrodes 3 per selection period in synchronization with the set sequential scanning. In concrete, the dot product computation means 8 carries out the predetermined dot product computation by sequentially reading out the set of pixel data stored in the frame memory 6 and forms a column signal component corresponding to a significance of each bit. The horizontal driver 5 generates a column signal which is applied to the group of column electrodes 3 by adequately arranging a column signal component with a significance of bit to which the pulse width modulation is performed and a column signal component with a significance of bit to which the frame thinning modulation is performed. The voltage level necessary for generating the column signal is supplied from the voltage level circuit 12 in advance. It is noted that the voltage level circuit 12 supplies a predetermined voltage level also to the vertical driver 4. The vertical driver 4 adequately selects a voltage level in accordance to the orthonormal function and supplies it to the group of row electrodes 2 as the row signal.

The gray shade driving device includes memory control means 10 for controlling read/write of pixel data into the frame memory 6. That is, it executes writing per all frame for bits for which the pulse width modulation in performed and executes writing per necessary frame in response to the frame thinning for bits for which the frame thinning modulation is performed. The gray shade driving device has a synchronizing circuit 9 and drive control means 11, in addition to the memory control means 10.

The synchronizing circuit 9 makes a pixel data read timing from the frame memory 6 and a signal transfer timing from the orthonormal function generating means 7 synchronize with each other. A desired image is displayed by repeating the set sequential scanning in & frame time interval. The synchronizing circuit 9 controls the timing of the memory control means 10. The memory control means 10 controls read/write of pixel data into the frame memory 6 by each bit plane as described above. The drive control means 11 is controlled by the synchronizing circuit 9 and supplies a predetermined clock signal to the vertical driver 4 to realize the doubling of the rate of the row signal as described above. The drive control means 11 also controls the horizontal driver 5 in response to the doubling of the rate of the row signal.

The present invention is characterized in that the vertical driver 4 doubles the rate of the row signal which is applied to the group of row electrodes 2 and repeats the same set sequential scanning at least for two frames of foregoing and next frames under the control of the drive control means 11. In contrast, the horizontal driver 5 divides the column signal component into the significant bit and less significant bit components, distributes one component to the foregoing one frame (hereinafter called the first half frame) and the other component to the next one frame (hereinafter called the second half frame) to generate a column signal which is applied to the group of column electrodes 3. Or, it is possible to arrange it so as to divide the significant bit column signal component and the less significant bit column signal component into half, respectively, and to distribute each half selected from the significant bit and less significant bit column signal components into the first half frame and the other half into the second half frame to generate the column signal which is applied to the group of column electrodes. At this time, the pulse width modulation is applied to the significant bit column signal component and the frame thinning modulation is applied to the less significant bit row signal component.

An operation of the gray shade driving device shown in FIG. 1 will be explained below in detail. In order to make it easy to understand the present invention, the principle thereof will be explained at first by exemplifying a case when four lines of row electrodes are concurrently selected with respect to the multiple line section. In order to simplify the explanation, the doubling of the rate of the row signals and the gray-shading of the column signals will not be mentioned here in the description of the principle.

Figure 2:
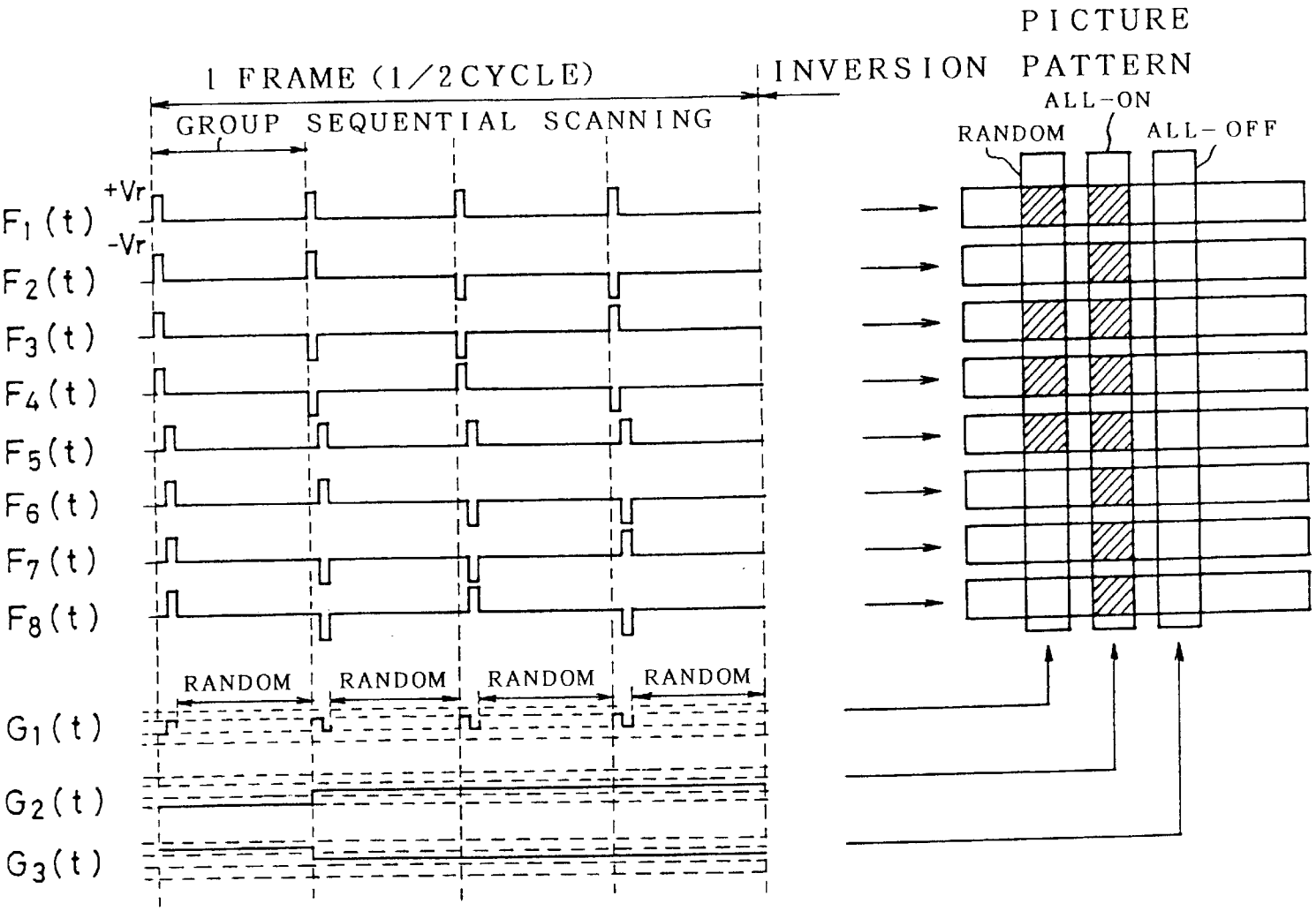
FIG. 2 is a timing chart for explaining an operation of the gray shade driving device of the present invention.

FIG. 2 is a waveform chart of the four-line concurrent driving. $F_1(t)$–$F^8(t)$ denotes row signals applied to respective row electrodes and $G_1(t)$–$G_3(t)$ denotes column signals applied to respective column electrodes. The row signal F is met according to Walsh function which is one of the complete orthonormal functions in (0, 1). The scanning waveform is set to "−Vr" corresponding to "0", set to "+Vr" corresponding to "1" and set to $V_0$ during a nonselection period. The voltage level $v_0$ for the nonselection period in set to 0 V. Four lines are selected concurrently as a set such that each set is sequentially scanned from top to bottom. One frame which corresponds to one period of the Walsh function is finished by four times of the set sequential scanning. In a next period, a set sequential scanning is carried out four times while the polarity of the signal is inverted to thereby remove a DC component. The inversion of the polarity is repeated per every two frames, thus completing one cycle. This cycle frequency is set to 30 Hz in accordance to TV standard for example. Accordingly, the frame frequency is doubled to 60 Hz. That is, each frame is repeated 60 times in one second.

On the other hand, the column signal applied to each group of column electrodes are dealt with by predetermined dot product computation in which each pixel data is $I_{ij}$ (where "i" denotes a row number of the matrix, and "j" denotes a column number of the matrix). Supposing a case in which pixel data includes not a plurality of bits but a single bit and $I_{ij}$ is set to "−1" when the pixel is ON and is set to "+1" when it is OFF, then the column data signal Gj(t) applied to each column electrode is basically set by carrying out the following dot product computation process:

[Equation 1]

$$G_j(t) = \frac{1}{N} \sum_{i=1}^{N} I_{ij} \times F_i(t)$$

In the above computation, the summation is effected only for the selected rows since the row signal is set to "0" level in the nonselection period. Accordingly, in the concurrent selection of the four lines, the column signal can take five voltage levels. Namely, the column signal requires a certain number of voltage levels equal to "concurrently selected line numbers+one". This potential level is supplied from the voltage level circuit 12 shown in FIG. 1 as described above.

Figure 3:
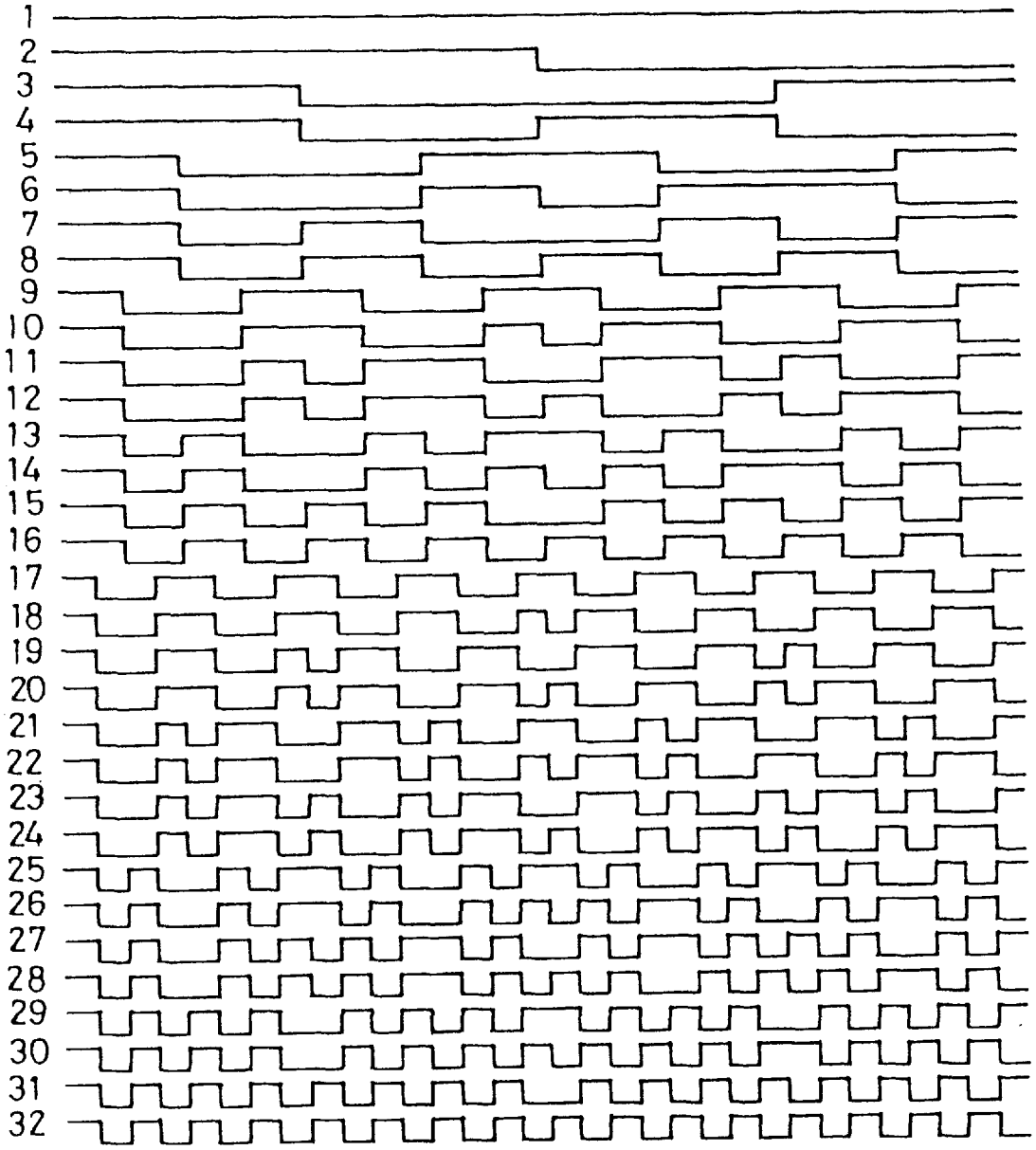
FIG. 3 is a waveform chart of Walsh function for explaining the operation of the same.

FIG. 3 is a waveform chart showing the Walsh function. In the case of the concurrent four-line selection, for example, four Walsh functions from the top are used to form the waveform of the row signals. As can be understood from a comparison between FIG. 2 and FIG. 3, for instance, the row signal $F_1(t)$ corresponds to the first walsh function. Because the function has a high level across one period, the four pulses of $F_1(t)$ are arranged in a sequence of (1, 1, 1, 1). $F_2(t)$ corresponds to the second Walsh function. The function has a high level in a first half of one period and a low level in a second half of one period. Accordingly, the pulses contained in $F_3(t)$ are arranged in a sequence of (1, 1, 0, 0). Likewise, the signal $F_3(t)$ corresponds to the third Walsh function, so that the pulses are arranged in a sequence of (1, 0, 0, 1). Further, $F_4(t)$ corresponds to the fourth Walsh function, so that the pulses are arranged in a sequence of (1, 0, 1, 0).

As can be understood from the above description, the set of the row signals applied to one set of the row electrodes are represented by an adequate combination pattern (1, 1, 1, 1), (1, 1, 0, 0), (1, 0, 0, 1) or (1, 0, 1, 0) based on the orthonormal relationship. In the case of FIG. 2, the second set receives the orthonormal signals $F_5(t)$–$F_8(t)$ in accordance to the same combination pattern. In a similar manner, the third and further sets receive the predetermined row signals corresponding to the same combination pattern, thus completing one set sequential scanning. One frame is finished by repeating the set sequential scanning by four times.

As long as the orthonormal relation is maintained in the multiple line section method, the voltage waveforms applied to the row electrodes may have various combination patterns. However, in the combination pattern indicated in FIG. 2, all of the concurrently selected lines are scanned by +Vr or −Vr once in one frame. For example, in the first set sequential scanning shown in FIG. 2, all the concurrently selected lines are applied with +Vr. Meanwhile, the voltage waveforms applied to the column signal electrodes are computed according to the predetermined dot product equation based on the pixel data. Accordingly, if the matrix pixel data represents a random picture pattern, the bias voltage in the nonselection period is randomly applied in one frame. However, if the picture pattern is placed in either of the all ON state and all OFF state, the bias voltage of the nonselection period is concentrated into a certain period in which all the concurrently selected lines are scanned by +Vr or −Vr. For this, the optical response is fluctuated to cause contrast variation dependently on the picture pattern.

Figure 4A:
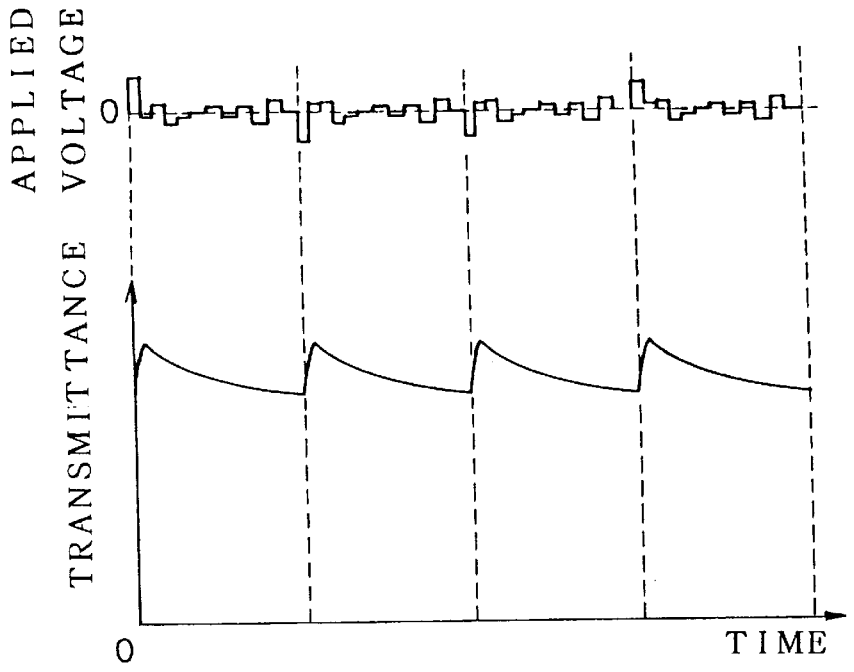
FIGS. 4A and 4B are optical response diagrams for explaining the operation of the same.
Figure 4B:
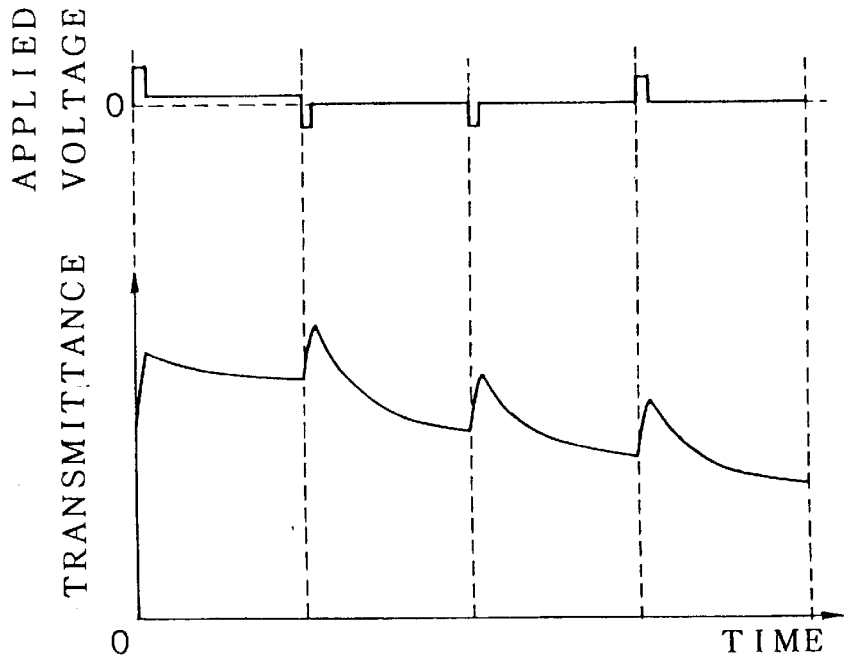

FIG. 4 illustrates how the contrast variation occurs dependently on the picture pattern. These graphs schematically represent the optical response and the voltage waveform actually applied to the liquid crystal in the four-line concurrent selection mode. FIG. 4A illustrates a case when a random pattern is represented and FIG. 4B illustrates a case when an all ON pattern is represented. As seen from these graphs, the bias voltage is concentrated into the first set sequential scanning period to thereby generate contrast fluctuation in the all ON pattern.

Figures 5A, 5B, 5C:
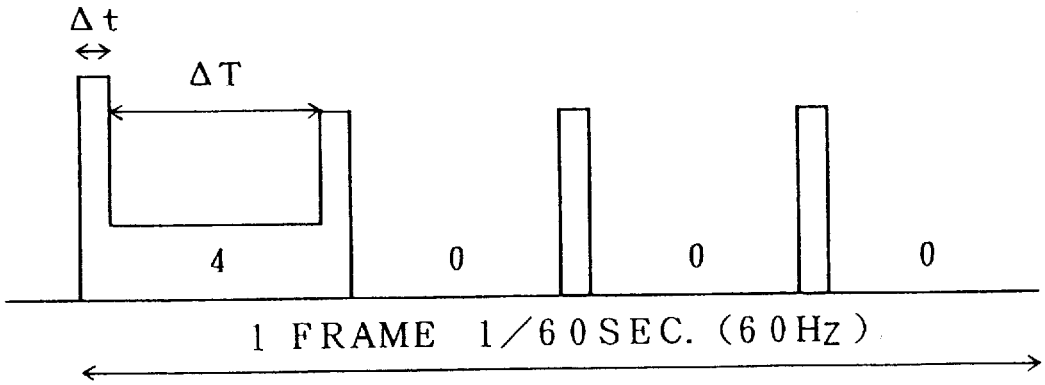
FIGS. 5A through 5E are double-rate waveform charts for explaining the operation of the same.

The row signal double-rate drive adopted in the present invention to restrain the fluctuation of optical response will be explained below with reference to FIG. 5. FIG. 5A shows liquid crystal applied voltage levels during the nonselection period in the four-line concurrent selection. In the first set sequential scanning, all four row signals $F_1$ through $F_4$ have +1 level. In the all ON state, all the pixel data $I_{ij}$ take −1 level. Accordingly, when the above-mentioned dot product computation is carried out, the row signal takes a level of absolute value 4, which is applied during the nonselection period. In the second set sequential scanning, $F_1$ and $F_2$ take +1 level and $F_3$ and $F_4$ take −1 level. Accordingly, in the all ON state, the plus and minus parts are canceled, so that a voltage applied during the nonselection period is zero level. Similarly, the voltage applied during the nonselection period is zero level also in the third and fourth set sequential scanning.

A waveform chart in FIG. 5C represents it as a graph. In the first met sequential scanning and during the nonselection period ΔT, the voltage of level of absolute value 4 is applied and in the second, third and fourth set sequential scanning, the voltage of level of absolute value a is applied during the nonselection period ΔT. One frame is finished by four times of set sequential scanning. When the frame period is 60 Hz as described before, the applied voltage is concentrated into the first set sequential scanning period, so that the frequency component of 60 Hz is intensified as a whole and the frame response becomes conspicuous.

Three-line concurrent selection is effective by a certain degree in dealing with this problem. In an example shown in FIG. 5B, three-line concurrent selection drive is carried out using three row signals $F_2$ through $F_4$, except of $F_1$. In the first set sequential scanning, a voltage of level of absolute value 3 is applied during the nonselection period. In the second set sequential scanning, there is a difference between the plus and minus parts, so that a voltage of level of absolute value 1 is applied during the nonselection period. Similarly, the voltage of level of absolute value 1 is applied during the nonselection period in the third and fourth set sequential scanning.

Figure 5D:
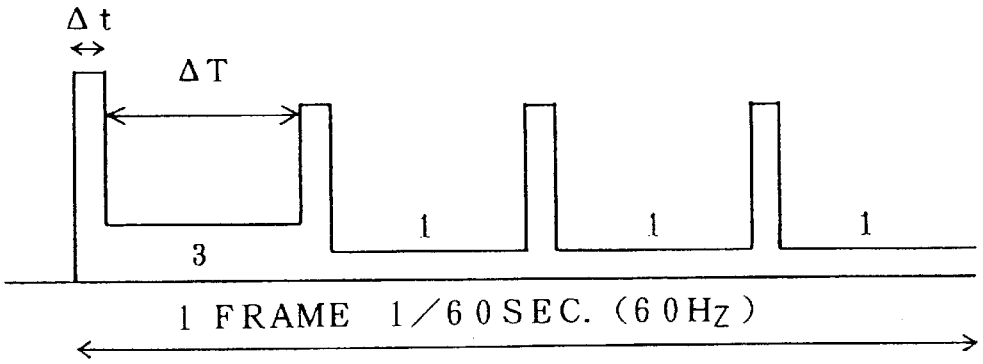

A waveform chart shown in FIG. 5D represents it as a graph. The voltage of level of absolute value 3 is applied during the nonselection period ΔT in the first set sequential scanning and the voltage of level of absolute value 1 is applied during the nonselection period in the second, third and fourth set sequential scanning. Because the difference of the voltages applied during the nonselection period in the first set sequential scanning and the second through fourth set sequential scanning is reduced to the level of absolute value 2 in the three-line concurrent selection as described above, the 60 Hz component is weakened as a whole and the frame response becomes inconspicuous. The odd-line concurrent selection is generally more effective as compared to the even-line concurrent selection because the voltage applied during the nonselection period can be spread out to each set sequential scanning. Accordingly, the present invention also adopts the odd-line concurrent selection method.

Figure 5E:
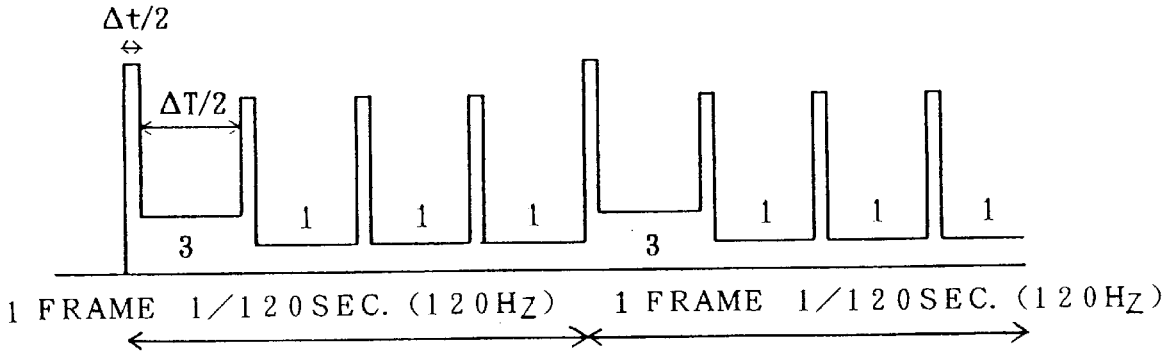

However, the 60 Hz component still remains as shown in FIG. 5D even in the odd-line concurrent selection. Then, the rate of the row signal is doubled as shown in FIG. 5E and it is applied to the row electrode in the present invention. That is, the same set sequential scanning is repeated at least for two frames of foregoing and next frames. Consequently, the frame frequency is increased to 120 Hz. The totally same drive is repeated in the first half frame and the second half frame. However, because the rate of the row signal is doubled, the selection period Δt is also reduced to half in the same time. By doubling the rate as described above, the 60 Hz component is eliminated and the 120 Hz component appears instead. The frame response can be restrained by increasing the rate of the frame frequency.

It should be noted that a horizontal shift drive method has been proposed in order to deal with the above-mentioned fluctuation of the optical response. In the multiple line section method, each group of the multiple lines is sequentially selected to scan the display face from top to bottom. At this time, the phase of the scanning signal waveforms applied to the row electrodes is shifted from that of the row signal waveforms selected just before it. By such an operation, the bias voltage applied to the liquid crystal during the nonselection period is spread out without being concentrated into one frame interval within one frame when all ON or all OFF display is made. This phase difference is effected such that the combination pattern of the waveform applied to the row electrode is phase-shifted at least by one period within the one set sequential scanning period.

Figure 6:
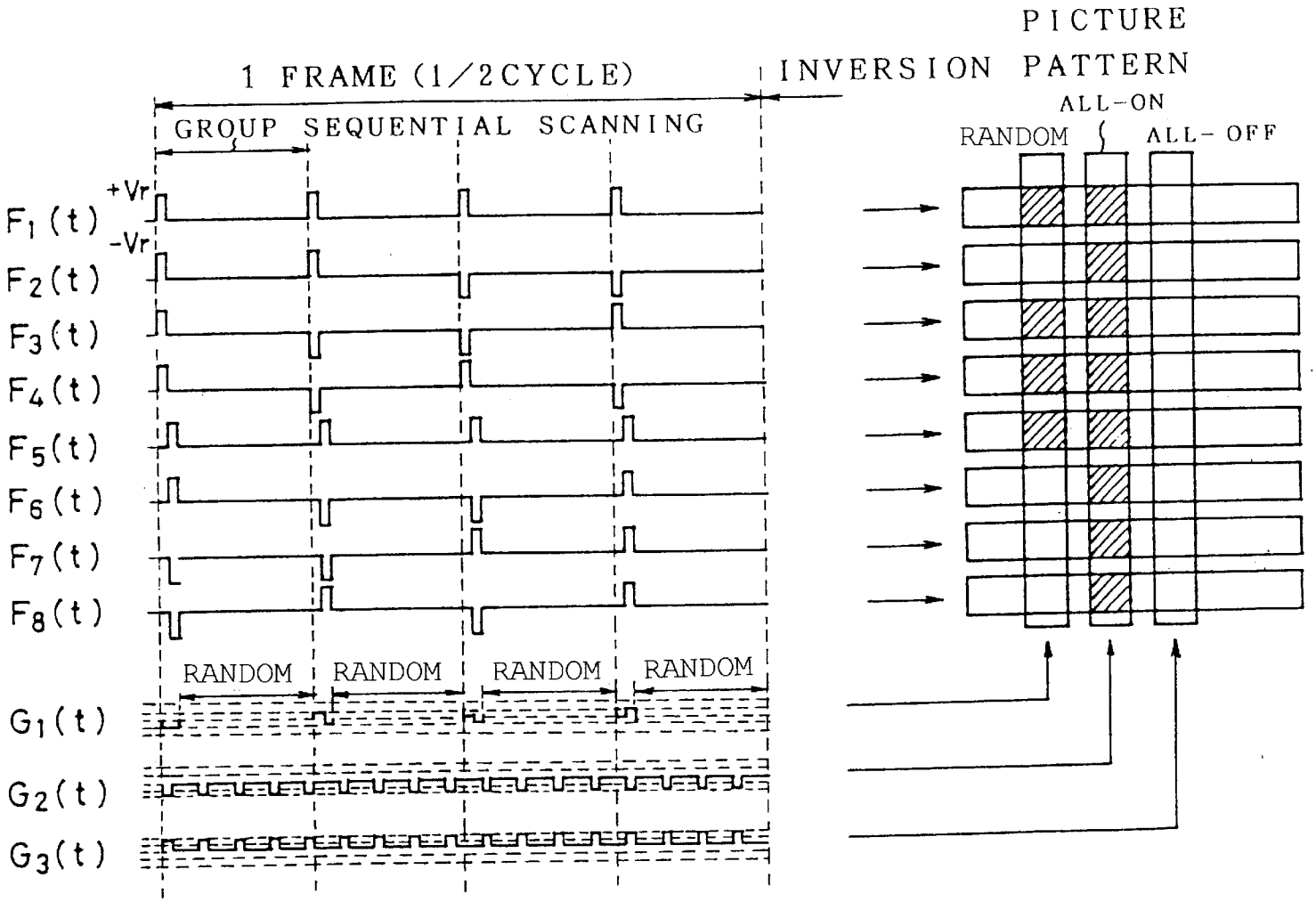
FIG. 6 is a timing chart for explaining the operation of the same.
Figure 7:
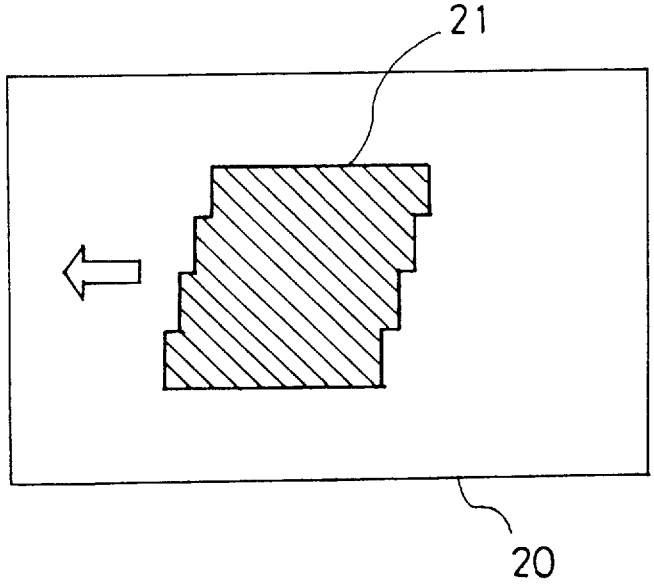
FIG. 7 is a schematic drawing for explaining the operation of the same.

In the conventional multiple line selection, although the contrast fluctuation is caused as described before when the combination pattern of the orthonormal function is fixed, the optical response is uniformed by shifting the phase of the voltage waveforms of the row signal, thus allowing the frame response to be restrained and the contrast to be improved when all ON or all OFF state. FIG. 6 shows one example of the horizontally phase-shifted driving waveforms. In the concurrent selection of four lines, the voltage waveforms of the row signals are arranged based on the Walsh function such that one phase is shifted every time when four lines are concurrently selected as a set. In FIG. 6, $F_1(t)$ denotes each scan signal waveform and each set of four lines is selected in set sequential manner to scan the liquid crystal display panel from top to bottom. In the first set sequential scanning, F1, F2, F3 and F4 are set to +Vr, +Vr, +Vr and +Vr, respectively. The next set of F5, F6, F7 and F8 are set to +Vr, +Vr, −Vr and −Vr, respectively, which are shifted by one phase from the preceding set. In similar manner, the row signals after Fe also phase-shifted sequentially are applied to the row electrodes. On the other hand, the respective column signal electrodes are applied with the column signals $G_1(t$, $G_2(t)$ and $G_3(t)$, which are computed according to the afore-mentioned dot product equation. In contrast to $G_2(t)$ in the all ON state and $G_3(t)$ in the all OFF state shown in FIG. 2, the voltage, applied to the column electrode, which has been concentrated into the first set sequential scanning period is generated once per four times of selection and is spread out uniformly throughout the whole one frame. Although the horizontal shift method is effective in restraining the frame response, it has a problem that in the case of video image in which all ON state picture pattern moves in the horizontal direction in contrary, the response speed differs per group of row electrodes concurrently selected, thus deforming the displayed image. FIG. 7 illustrates it schematically. When all ON state picture pattern 21 displayed on a screen 20 moves in the horizontal direction, differences of levels are brought about in a unit of selected number of lines, thus disturbing the uniformity of the image, Accordingly, although the horizontal shift method is effective by a certain degree, it has a drawback in that the discrepancy of the response speeds in the vertical direction appears. On the other hand, the frame response can be restrained and no discrepancy of the response speeds in the direction appears by adopting the odd-line concurrent selection method and by driving by doubling the rate of the row signal in accordance to the present invention.

The driving method in which the row signal double rate drive and the column signal gray shade drive are combined, the main subject of the present invention, will be explained below.

When the gray shade display is carried out in accordance to the present invention, each pixel data has a structure of a plurality of bits. The dot product computation in this case will be explained below.

FIG. 8 shows a case when eight gradation level display is made by inputting pixel data composed of three bits for example. As shown in FIG. 8, each pixel data has a second bit which corresponds to a significant bit, a first bit which corresponds to a less significant bit and a third or zero-th bit which corresponds to a least significant bit. Each bit can take a binary value of 0 or 1. When three bits are all 0, it represents the lowest 0-th gradation and when the three bits are all 1, it represents the highest seventh gradation. A desirable half-tone display may be obtained depending on the value which each bit takes. The dot product computation described above is carried out to the pixel data having such three-bit structure by dividing per significance of bit. That is, the dot product computation is carried out to the set of the second bits with the set of the orthonormal functions at first to generate a column signal component corresponding to the significant bit. Next, the similar dot product computation is carried out between the set of the first bits and the set of the orthonormal functions to generate a column signal component corresponding to the less significant bit. Finally, the similar dot product computation is carried out between the set of the zero-th bits and the set of the orthonormal functions to generate a column signal component corresponding to the least significant bit.

Figure 9:
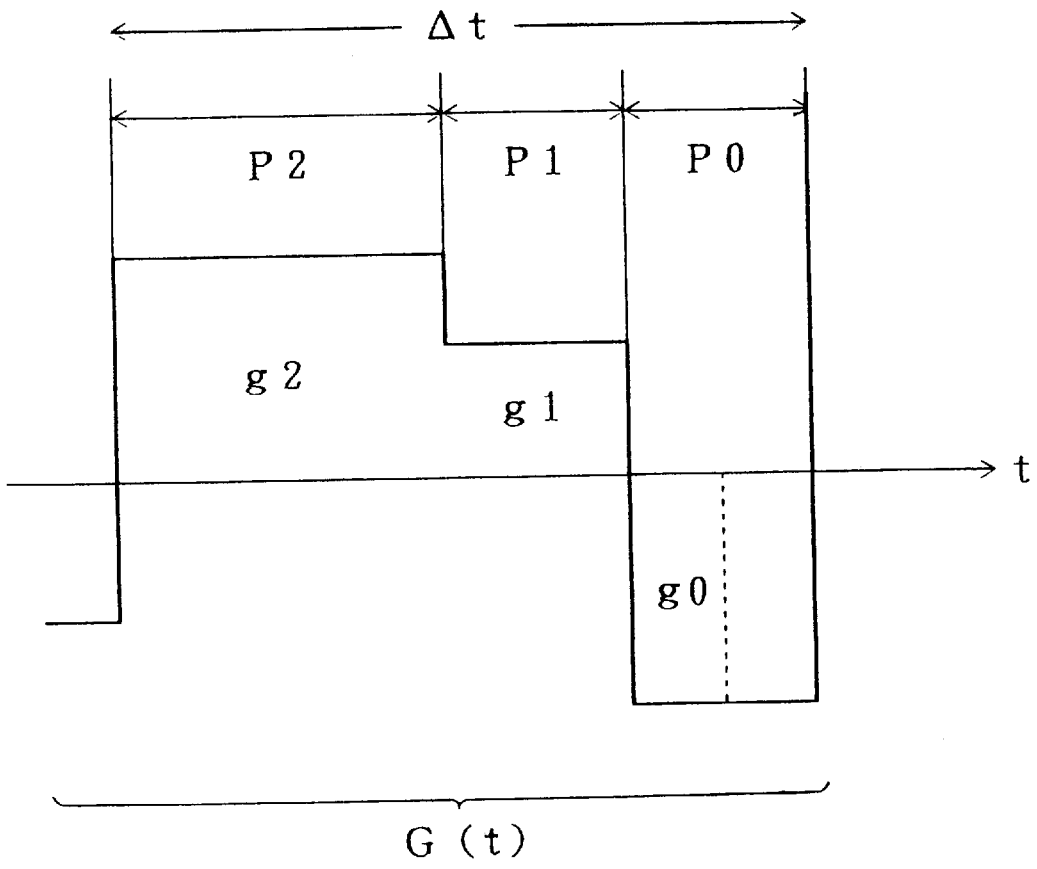
FIG. 9 is a waveform chart for explaining the operation of the gray shade display of the same.

FIG. 9 illustrates a case when the column signal components generated as described above are arranged plainly to make a column signal. In the graph in FIG. 9, the horizontal axis represents an elapsed time t and the vertical axis represents a voltage level of a column signal G(t). As described before, the column signal G(t) takes a predetermined voltage level according to the result of the dot product computation. The column signal G(t) contains three column signal components g2, g1 and g0 corresponding to three bits contained in the pixel data within one selection period Δt. The first column signal component g2 is what has been dot-product computed by using the set of second bits shown in FIG. 8 and corresponds to the significant bit. The next column signal component g1 corresponds to the less significant bit. The final column signal component g0 corresponds the least significant bit.

In the present invention, the pulse width modulation is applied to the significant bit and the less significant bit and the frame thinning modulation is applied to the least significant bit. Due to that, a pulse width P2 of the column signal component g2 which corresponds to the significant bit is the largest. A pulse width P1 of the next column signal component g1 which corresponds to the less significant bit in half of P2. As for the column signal component go which corresponds to the least significant bit, its pulse width P0 becomes half of P1 if the pulse width modulation is applied. However, because the frame thinning modulation is applied to the least significant bit here, the pulse width P0 of the column signal component go is equal with the pulse width P1 of the column signal component g1 of the less significant bit which is above that by one. By actually outputting the column signal component go once per two frames in the arrangement described above, the effective pulse width thereof becomes half of P0 and ½ gradation may be realized when it is averaged throughout each frame. The extreme reduction of the pulse width may be prevented and the burden in designing the circuit may be reduced by applying the frame thinning modulation to the less significant bit as described above. It should be noted that the present invention is not confined only to the arrangement described above. For example, the significance of bit to which the frame thinning modulation in applied is freely selected and ¼ gradation may be realized, not only the ½ gradation. In the case of the ¼ gradation, the frame thinning is carried out once per four times.

Figure 10A:
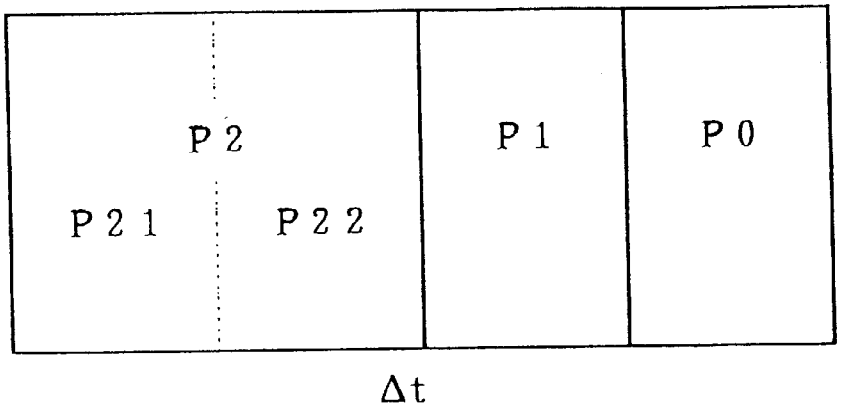
FIGS. 10A through 10C are schematic diagrams for explaining the gray shade display adapted to the double-rate driving.

By the way, the selection period Δt becomes half when the rate of the row signal is doubled. Accordingly, the pulse width P of each column signal component is also divided into half, respectively. When the column signal shown in FIG. 9 is used as it is in such a state, the pulse width of the less significant hit becomes extremely narrow, thus increasing the burden in designing the circuit. Then, the column signal is also adequately processed in accordance to the doubling of the rate of the row signal to prevent the pulse width from being extremely reduced. This point will be explained in detail with reference to FIG. 10. FIG. 10A schematically shows a rate of the pulse width of each column signal component taking in one selection period Δt. P2 takes a half of Δt. P1 also takes a quarter of Δt and P0 also takes a half of Δt. Accordingly, if P2 is divided into P21 and P22, each divided part takes a quarter of Δt. In other words, P21, P22, P1 and P0 all have the same pulse width. The pulse width is dispersed using that.

Figure 10B:
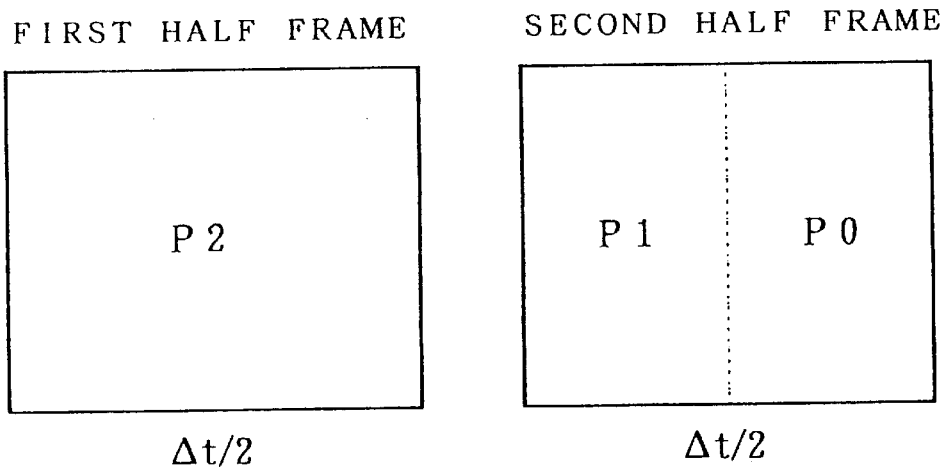

FIG. 10B shows a first example of the dispersion. As described before, when the rate of the row signal is doubled and it is applied to the group of row electrodes, the same set sequential scanning is repeated at least two times for the first and second half frames. The selection period of both the first half frame and the second half frame becomes a half of the original selection period Δt. In this example, the original column signal is divided into a significant bit side (P2) and a loss significant bit side (P1, P0) and one component (P2) is distributed to the first half frame and the other (p1, P0) to the second half frame to compose a column signal which is then applied to the group of column electrode. Thereby, it becomes possible to accommodate with the double-rate drive of the row signal without reducing the pulse width of each column signal component.

Figure 10C:
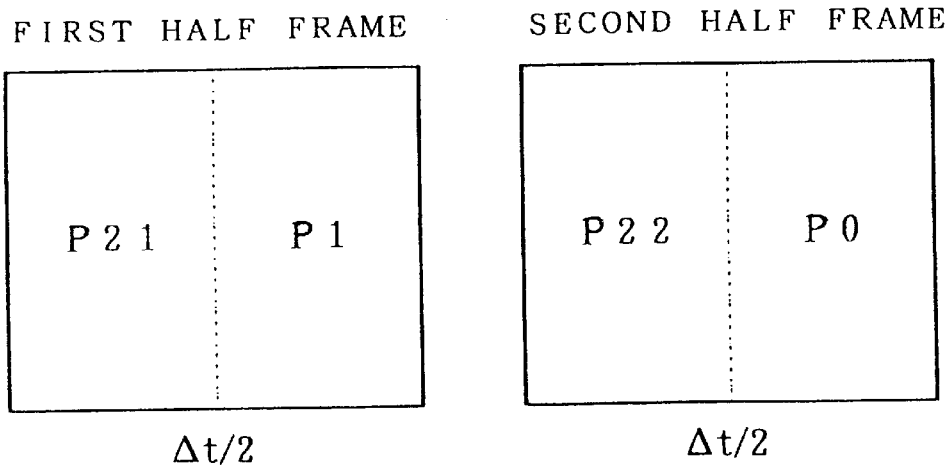

FIG. 10C shows another example. In this case, the significant bit column signal component (P2) is divided into P21 and P22. Similarly, the less significant bit column signal components (P1 and P0) are divided into P1 and P0. Then, each half component (P21 and P1) is selected from the significant bit and less significant bit components to distribute to the first half frame and to distribute the remaining each half (P22 and P0) to the second half frame to compose a column signal which is then applied to the group of column electrodes. Thereby, it becomes possible to accommodate with the double-rate drive of the row signal without reducing the pulse width of each column signal component.

As described above, according to the present invention, the row signal is applied to the group of row electrodes by doubling the rate thereof and the same set sequential scanning is repeated at least for two frames of foregoing and next frames. Thereby, the rate of the frame frequency can be increased, thus allowing the frame response to be restrained. Further, the column signal in distributed to the first half frame and the second half frame in response to the doubling of the rate of the row signal to allow the gray shade display without reducing the pulse width.

What is claimed is:

1. A liquid crystal display panel gray shade driving device for driving, according to given pixel data composed of a plurality of bits, a liquid crystal display panel having pixels in a matrix by interposing a liquid crystal layer between a group of row electrodes and a group of column electrodes, the liquid crystal display tray shade driving device comprising:

first means for applying a plurality of row signals represented by a set of orthonormal functions to the group of row electrodes throughout one frame by set sequential scanning for each of selecting periods, the first means having orthonormal function generating means for forming the plurality of row signals and vertical driving means for doubling the rate of the row signal applied to the group of row electrodes and repeating the same set sequential scanning at least for two frames of previous and subsequent frames; and second means for sequentially carrying out a dot product computation between the set of orthonormal functions and a set of pixel data, and applying a column signal having a voltage level corresponding to a result of the computation to the group of column electrodes in synchronization with the set sequential scanning for each of the selecting periods, the second means having a frame memory for holding the pixel data in each frame while dividing it according to a significance of each bit, dot product computing means for reading out the set of held pixel data per significance of each bit and carrying out the dot product computation to generate a column signal component corresponding to the significance of each bit, and horizontal driving means for dividing the column signal components into a significant bit component and a less significant bit component, distributing one of the bit components to the previous frame and distributing the other of the bit components to the subsequent frame to generate a column signal for application to the group of column electrodes.

2. A liquid crystal display panel gray shade driving device for driving, according to given pixel data composed of a plurality of bits, a liquid crystal display panel having pixels in a matrix by interposing a liquid crystal layer between a group of row electrodes and a group of column electrodes, the liquid crystal display gray shade driving device comprising:

first means for applying a plurality of row signals represented by a set of orthonormal functions to the group of row electrodes throughout one frame by set sequential scanning for each of selecting periods, the first means having orthonormal function generating means for forming the plurality of row signals and vertical driving means for doubling the rate of the row signal applied to the group of row electrodes and repeating the same set sequential scanning at least for two frames of previous and subsequent frames; and second means for sequentially carrying out a dot product computation between the set of orthonormal functions and a set of pixel data, and applying a column signal having a voltage level corresponding to a result of the computation to the group of column electrodes in synchronization with the set sequential scanning for each of the selecting periods, the second means having a frame memory for holding the pixel data in each frame while dividing it according to a significance of each bit, dot product computing means for reading out the set of held pixel data per significance of each bit and carrying out the dot product computation to generate a column signal component corresponding to the significance of each bit, and horizontal driving means for dividing the significant bit column signal component and the less significant bit column signal component into half, respectively, and distributing each half selected from the significant bit and less significant bit column signal components into the previous frame and the remaining each half to the subsequent frame to generate a column signal for application to the group of column electrodes.

3. A liquid crystal display panel gray shade driving device according to claim 1 or 2; wherein the horizontal driving means applies the column signal components using both pulse width modulation and frame thinning modulation with respect to the less significant bit component while it applies the column signal components by pulse width modulation with respect to the significant bit component.

4. A liquid crystal display panel gray shade driving device comprising:

a liquid crystal display panel having a group of row electrodes, a group of column electrodes spaced from and intersecting the row electrodes to define a pixel at each intersection, and a liquid crystal layer disposed between the group of row electrodes and the group of column electrodes;

first means for applying a plurality of row signals, by doubling the rate thereof, to the group of row electrodes throughout a first frame by set sequential scanning for each of selecting periods and repeating the same set sequential scanning at least for a frame previous and a frame subsequent to the first frame; and second means for holding a set of pixel data, consisting of a plurality of bits, in each frame while dividing it according to a significance of each bit, reading out the set of pixel data according to the significance of each bit, sequentially carrying out a dot product computation between a set of orthonormal functions representing the plurality of row signals and the set of pixel data to generate a column signal component corresponding to the significance of each bit, dividing the column signal components into a significant bit component and a less significant bit component, and distributing one of the bit components into the previous frame and the other of the bit components into the subsequent frame to generate a column signal for application to the group of column electrodes.

5. A liquid crystal display panel gray shade driving device according to claim 4; wherein the second means distributes the less significant component by both pulse width modulation and frame thinning modulation and distributes the significant bit component by pulse width modulation.

6. A liquid crystal display panel gray shade driving device comprising:

a liquid crystal display panel having a group of row electrodes, a group of column electrodes spaced from and intersecting the row electrodes to define a pixel at each intersection, and a liquid crystal layer disposed between the group of row electrodes and the group of column electrodes;

first means for applying a plurality of row signals, by doubling the rate thereof, to the group of row electrodes throughout a first frame by set sequential scanning for each of selecting periods and repeating the same set sequential scanning at least for a frame previous and a frame subsequent to the first frame; and second means for holding a set of pixel data, consisting of a plurality of bits, in each frame while dividing it according to a significance of each bit, reading out the set of pixel data according to the significance of each bit, sequentially carrying out a dot product computation between a set of orthonormal functions representing the plurality of row signals and the set of pixel data to generate a column signal component corresponding to the significance of each bit, dividing the column signal component corresponding to a significant bit and the column signal component corresponding to a less significant bit into half, respectively, and distributing each half selected from the significant bit and less significant bit column signal components into the previous frame and the remaining each half into the subsequent frame to generate a column signal for application to the group of column electrodes.

7. A liquid crystal display panel gray shade driving device according to claim 6; wherein the second means distributes the less significant bit column signal component by both pulse width modulation and frame thinning modulation and distributes the significant bit column signal component by pulse width modulation.

* * * * *